US011417957B2

(12) United States Patent
Hashiguchi

(10) Patent No.: US 11,417,957 B2
(45) Date of Patent: Aug. 16, 2022

(54) ANTENNA

(71) Applicant: JAPAN AVIATION ELECTRONICS INDUSTRY, LIMITED, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 38 days.

(21) Appl. No.: 17/064,919

(22) Filed: Oct. 7, 2020

(65) Prior Publication Data

US 2021/0175626 A1 Jun. 10, 2021

(30) Foreign Application Priority Data

Dec. 5, 2019 (JP) ..... JP2019-220300

(51) Int. Cl.
*H01Q 7/00* (2006.01)
*H01Q 1/38* (2006.01)

(52) U.S. Cl.
CPC ..... *H01Q 7/00* (2013.01); *H01Q 1/38* (2013.01)

(58) Field of Classification Search
None
See application file for complete search history.

(56) References Cited

U.S. PATENT DOCUMENTS 6,950,068 B2 9/2005 Bordi et al.
7,518,567 B2 4/2009 Utagawa et al.
10,476,143 B1 11/2019 Buccinna et al.
11,101,563 B2 * 8/2021 Hashiguchi ..... H01Q 1/12
2003/0112188 A1 * 6/2003 Bordi ..... H01Q 9/0442 343/702
2007/0013590 A1 1/2007 Shinkai
(Continued)

FOREIGN PATENT DOCUMENTS

CN 112928435 * 6/2021 ..... H01Q 1/22
EP 1313165 A2 5/2003
(Continued)

OTHER PUBLICATIONS

Taiwanese Office Action (and English language translation thereof) dated Jul. 9, 2021, issued in counterpart Taiwanese Application No. 109135484.
(Continued)

*Primary Examiner* — Trinh V Dinh
(74) *Attorney, Agent, or Firm* — Holtz, Holtz & Volek PC

(57) ABSTRACT

An antenna comprises a split ring resonator. The antenna has a main portion which forms a split ring with a split portion. The main portion has an upper surface portion, a first fixed portion, a second fixed portion, a third fixed portion, a first reinforcing portion, a second reinforcing portion, a feed portion, a first end portion and a second end portion. Each of the first fixed portion, the second fixed portion and the third fixed portion is fixed on a circuit board when the antenna is mounted on the circuit board. Lower ends of the first fixed portion, the second fixed portion and the third fixed portion define an imaginary plane perpendicular to an up-down direction. Each of lower ends of the first reinforcing portion, the second reinforcing portion and the feed portion is positioned between the upper surface portion and the imaginary plane in the up-down direction.

10 Claims, 5 Drawing Sheets

(56) References Cited

U.S. PATENT DOCUMENTS

| | | | | |
|---|---|---|---|---|
| 2016/0294048 | A1 | 10/2016 | Xu et al. | |
| 2020/0287269 | A1* | 9/2020 | Hashiguchi | H01Q 1/38 |
| 2020/0335849 | A1* | 10/2020 | Hashiguchi | H01Q 1/36 |
| 2020/0412024 | A1* | 12/2020 | Hashiguchi | H01Q 23/00 |
| 2021/0175626 | A1* | 6/2021 | Hashiguchi | H01Q 1/12 |

FOREIGN PATENT DOCUMENTS

| | | | |
|---|---|---|---|
| JP | 2007027894 | A | 2/2007 |
| JP | 2007221774 | A | 8/2007 |
| JP | 2008079303 | A | 4/2008 |
| JP | 2016518779 | A | 6/2016 |
| JP | 1633799 | S | 6/2019 |

OTHER PUBLICATIONS

Extended European Search Report (EESR) dated Apr. 16, 2021 issued in counterpart European Application No. 20203135.7.

Korean Office Action (and English language translation thereof) dated Jan. 25, 2022, issued in counterpart Korean Application No. 10-2020-0138132.

* cited by examiner

ANTENNA

CROSS REFERENCE TO RELATED APPLICATIONS

This application is based on and claims priority under 35 U.S.C. § 119 to Japanese Patent Application No. JP2019-220300 filed Dec. 5, 2019, the contents of which are incorporated herein in their entirety by reference.

BACKGROUND OF THE INVENTION

This invention relates to an antenna comprising a split ring resonator.

Referring to FIGS. 8 and 9, an antenna 900 of JPS1633799 comprises a split ring resonator. Specifically, the antenna 900 comprises a main portion 910 and a facing portion 920. The main portion 910 mainly functions as an inductor, and the facing portion 920 mainly functions as a capacitor. The main portion 910 forms a split ring. The main portion 910 is provided with a feed terminal 912. The facing portion 920 is provided on a split portion of the split ring. The main portion 910 is soldered on a circuit board by three fixed portions 930 at three points. The three fixed portions 930 prevent variation of attitude of the antenna 900 upon mounting of the antenna 900 on the circuit board.

If the main portion has an increased size, a part of the main portion other than the fixed portions has an increased size. Accordingly, the antenna with the increased size might be deformed when external force is applied to the main portion. The increase of the number of the fixed portions can prevent the deformation of the antenna. If the antenna is, however, fixed on a circuit board at four or more points, the antenna has great variation in its attitude upon mounting of the antenna on the circuit board. Thus, the antenna with four or more of the fixed portions cannot have constant or stable characteristics.

SUMMARY OF THE INVENTION

It is therefore an object of the present invention to provide an antenna which is resistant to external force and has constant characteristics.

One aspect of the present invention provides an antenna comprising a split ring resonator. The antenna has a main portion which forms a split ring with a split portion. The main portion has an upper surface portion, a first fixed portion, a second fixed portion, a third fixed portion, a first reinforcing portion, a second reinforcing portion, a feed portion, a first end portion and a second end portion. Each of the first fixed portion, the second fixed portion, the third fixed portion, the first reinforcing portion, the second reinforcing portion and the feed portion extends from the upper surface portion. Each of the first fixed portion, the second fixed portion and the third fixed portion is fixed on a circuit board when the antenna is mounted on the circuit board. Each of the first fixed portion, the second fixed portion and the third fixed portion has a lower end in an up-down direction. The lower ends of the first fixed portion, the second fixed portion and the third fixed portion define an imaginary plane perpendicular to the up-down direction. When the main portion is deformed by applying external force to the main portion under a state where the antenna is mounted on the circuit board, each of the first reinforcing portion and the second reinforcing portion abuts against the circuit board to prevent the main portion from being excessively deformed. The first reinforcing portion is positioned between the first fixed portion and the second fixed portion. The second reinforcing portion is positioned between the second fixed portion and the third fixed portion. Each of the first end portion and the second end portion is positioned between the first fixed portion and the third fixed portion. The first end portion and the second end portion form the split portion of the split ring. Each of the first reinforcing portion, the second reinforcing portion and the feed portion has a lower end in the up-down direction. Each of the lower ends of the first reinforcing portion, the second reinforcing portion and the feed portion is positioned between the upper surface portion and the imaginary plane in the up-down direction.

The antenna of the present invention is fixed on a circuit board by the three fixed portions, or the first fixed portion, the second fixed portion and the third fixed portion. The three fixed portions can prevent variation of attitude of the antenna upon mounting of the antenna on a circuit board. Thus, the antenna of the present invention can have constant characteristics.

The main portion of the antenna of the present invention is provided with the first reinforcing portion and the second reinforcing portion. Each of the lower ends of the first reinforcing portion and the second reinforcing portion is positioned between the upper surface portion of the main portion and the imaginary plane in the up-down direction. In other words, each of the lower ends of the first reinforcing portion and the second reinforcing portion is positioned above any of the lower ends of the first fixed portion, the second fixed portion and the third fixed portion in the up-down direction. Accordingly, none of the first reinforcing portion and the second reinforcing portion affects the attitude of the antenna when the antenna is mounted on a circuit board. If external force is applied to the main portion, the first reinforcing portion or the second reinforcing portion abuts against the circuit board to prevent the main portion from being excessively deformed. Thus, the antenna of the present invention is resistant to external force.

An appreciation of the objectives of the present invention and a more complete understanding of its structure may be had by studying the following description of the preferred embodiment and by referring to the accompanying drawings.

Figure 1:
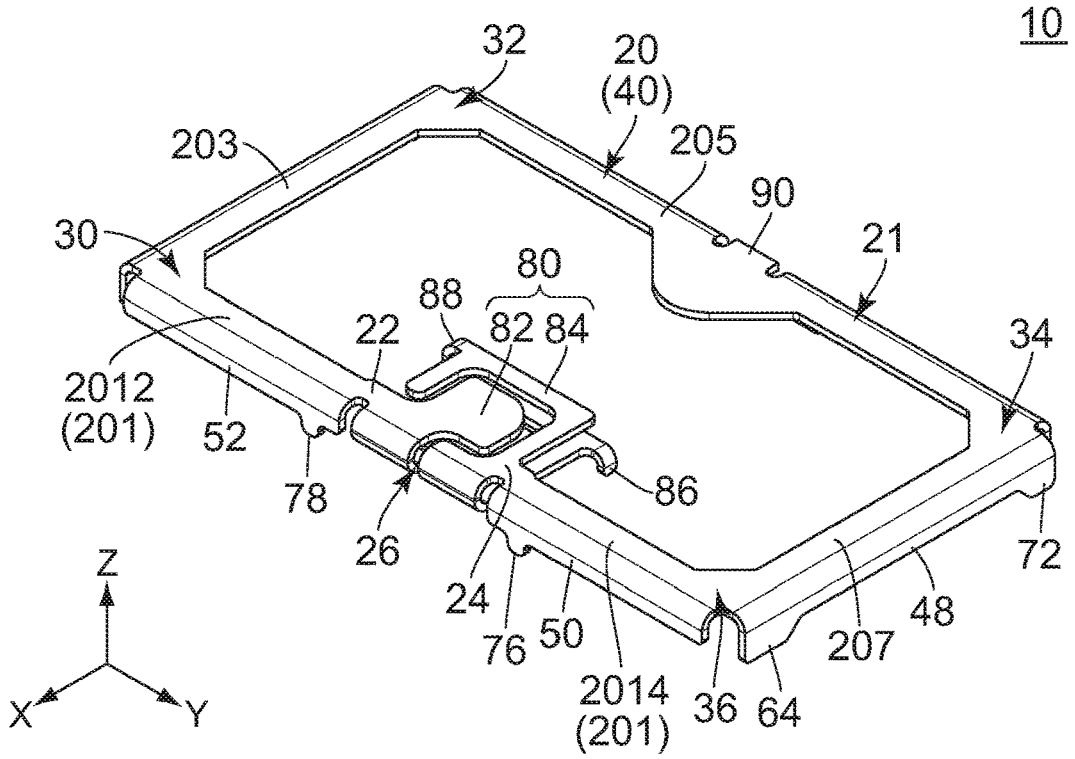
FIG. 1 is a top, perspective view showing an antenna according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 3:
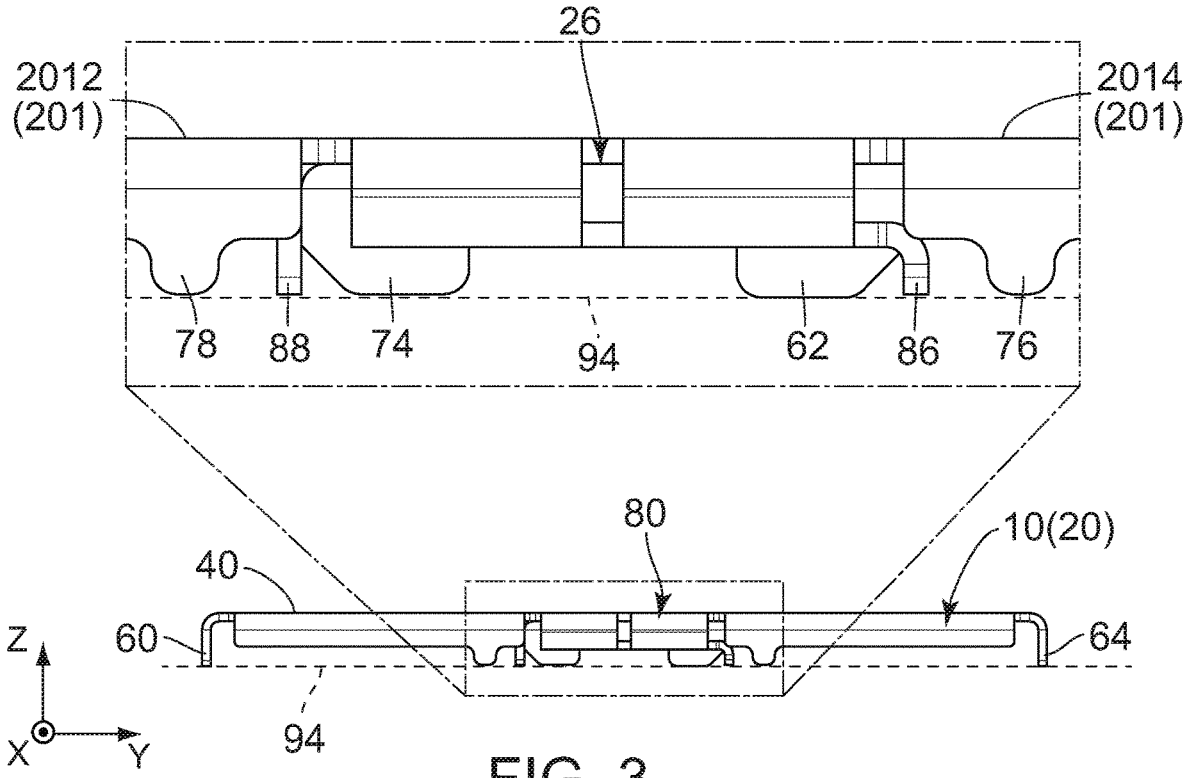
FIG. 3 is a front view showing the antenna of FIG. 1. In the figure, a part of the antenna is illustrated enlarged.

Referring to FIG. 3, an antenna 10 according to an embodiment of the present invention is a discrete member which is mounted on a circuit board (not shown) when used. The circuit board has an upper surface (not shown), and the upper surface is formed with a plurality of connecting pads (not shown). In addition, the circuit board comprises a feed line (not shown) and a ground plane (not shown).

Referring to FIG. 1, the antenna 10 of the present embodiment is the discrete member which is formed by punching out a single metal plate, followed by bending it. The antenna 10 has a split ring resonator. In other words, the antenna 10 of the present embodiment is a resonant antenna. The antenna 10 comprises a main portion 20 and a facing portion 80.

Referring to FIG. 1, the main portion 20 of the present embodiment forms a split ring 21. In other words, the antenna 10 comprises the main portion 20 which forms the split ring 21. The main portion 20 has an angular C-shape. Specifically, the main portion 20 has a ring shape with a split portion 26. The wording "ring shape" as used herein includes not only a substantially rectangular ring shape as the present embodiment and a circular shape but also an elliptical annular shape and a polygonal annular shape. The main portion 20 forms an inductor.

Figure 2:
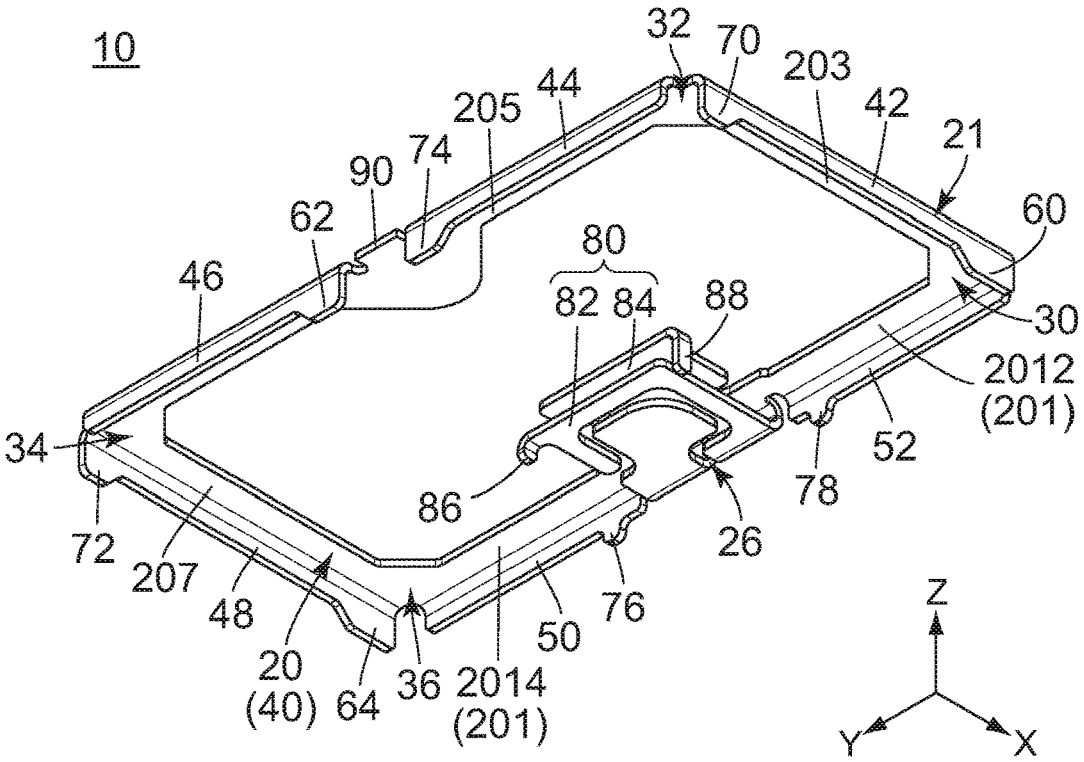
FIG. 2 is a bottom, perspective view showing the antenna of FIG. 1.

As shown in FIGS. 1 and 2, the main portion 20 of the present embodiment has an upper surface portion 40, a first end portion 22, a second end portion 24, a first fixed portion 60, a second fixed portion 62, a third fixed portion 64, a first reinforcing portion 70, a second reinforcing portion 72, a feed portion 76, an first additional reinforcing portion 74, a second additional reinforcing portion 78 and a portion 90.

As shown in FIG. 1, the upper surface portion 40 of the present embodiment has a flat-plate shape. More specifically, the upper surface portion 40 has the flat-plate shape perpendicular to the up-down direction. The upper surface portion 40 has a first portion 201, a first corner portion 30, a second portion 203, a second corner portion 32, a third portion 205, a third corner portion 34, a fourth portion 207 and a fourth corner portion 36. In other words, the main portion 20 has the first corner portion 30, the second corner portion 32, the third corner portion 34 and the fourth corner portion 36.

As shown in FIG. 1, the first portion 201 of the present embodiment extends in a right-left direction. The first portion 201 defines a front end of the upper surface portion 40 in a front-rear direction. In the present embodiment, the right-left direction is a Y-direction. Specifically, it is assumed that rightward is a positive Y-direction while leftward is a negative Y-direction. In the present embodiment, the front-rear direction is an X-direction. Specifically, forward is a positive X-direction while rearward is a negative X-direction.

As shown in FIG. 1, the first portion 201 consists of a left portion 2012 and a right portion 2014.

As shown in FIG. 1, the left portion 2012 of the present embodiment extends rightward in the right-left direction from the first corner portion 30. The left portion 2012 is positioned leftward of the right portion 2014 in the right-left direction.

As shown in FIG. 3, the right portion 2014 of the present embodiment extends leftward in the right-left direction from the fourth corner portion 36. The left portion 2012 and the right portion 2014 are not directly connected with each other. The right portion 2014 is positioned rightward of the left portion 2012 in the right-left direction.

As shown in FIG. 1, the first corner portion 30 of the present embodiment is positioned at a left end of the left portion 2012 in the right-left direction. The first corner portion 30 is positioned at a front end of the second portion 203 in the front-rear direction. The first corner portion 30 couples the left portion 2012 and the second portion 203 with each other.

As shown in FIG. 1, the second portion 203 of the present embodiment extends rearward in the front-rear direction from the first corner portion 30. The second portion 203 defines a left end of the upper surface portion 40.

As shown in FIG. 1, the second corner portion 32 of the present embodiment is positioned at a rear end of the second portion 203 in the front-rear direction. The second corner portion 32 is positioned at a left end of the third portion 205 in the right-left direction. The second corner portion 32 couples the second portion 203 and the third portion 205 with each other.

As shown in FIG. 1, the third portion 205 of the present embodiment extends rightward in the right-left direction from the second corner portion 32. The third portion 205 defines a rear end of the upper surface portion 40.

As shown in FIG. 1, the third corner portion 34 of the present embodiment is positioned at a right end of the third portion 205 in the right-left direction. The third corner portion 34 is positioned at a rear end of the fourth portion 207 in the front-rear direction. The third corner portion 34 couples the third portion 205 and the fourth portion 207 with each other.

As shown in FIG. 1, the fourth portion 207 of the present embodiment extends forward in the front-rear direction from the third corner portion 34. The fourth portion 207 defines a right end of the upper surface portion 40.

As shown in FIG. 1, the fourth corner portion 36 of the present embodiment is positioned at a front end of the fourth portion 207 in the front-rear direction. The fourth corner portion 36 is positioned at a right end of the right portion 2014 in the right-left direction. The fourth corner portion 36 couples the fourth portion 207 and the right portion 2014 with each other.

As shown in FIG. 1, the first end portion 22 of the present embodiment is provided on the left portion 2012 of the first portion 201. The first end portion 22 is positioned at a right end of the left portion 2012 in the right-left direction.

As shown in FIG. 1, the second end portion 24 of the present embodiment is provided on the right portion 2014 of the first portion 201. The second end portion 24 is positioned at a left end of the right portion 2014 in the right-left direction.

As shown in FIG. 1, each of the first end portion 22 and the second end portion 24 is positioned between the first corner portion 30 and the fourth corner portion 36. As understood from FIGS. 1 and 2, each of the first end portion 22 and the second end portion 24 is positioned between the first fixed portion 60 and the third fixed portion 64. The first end portion 22 and the second end portion 24 form the split portion 26.

As shown in FIG. 2, the first fixed portion 60 of the present embodiment extends from the upper surface portion 40. The first fixed portion 60 is provided on the first corner portion 30. The first fixed portion 60 is positioned below the second portion 203 in an up-down direction. In the present embodiment, the up-down direction is a Z-direction. Specifically, upward is a positive Z-direction while downward is a negative Z-direction.

As shown in FIG. 2, the second fixed portion 62 of the present embodiment extends from the upper surface portion 40. The second fixed portion 62 is positioned between the second corner portion 32 and the third corner portion 34. The second fixed portion 62 is positioned below the third portion 205 in the up-down direction.

As shown in FIG. 2, the third fixed portion 64 of the present embodiment extends from the upper surface portion 40. The third fixed portion 64 is provided on the fourth corner portion 36. The third fixed portion 64 is positioned below the fourth portion 207 in the up-down direction. As shown in FIG. 3, the arrangement of the third fixed portion 64 and the first fixed portion 60 is surface-symmetrical with respect to a plane which is perpendicular to the right-left direction and which passes through a middle, in the right-left direction, of the main portion 20. Hereinafter, the plane is referred to as "reference plane". The third fixed portion 64 and the first fixed portion 60 are arranged mirror-symmetrically to each other across the first portion 201.

As shown in FIG. 3, lower ends of the first fixed portion 60, the second fixed portion 62 and the third fixed portion 64 define an imaginary plane 94 perpendicular to the up-down direction. The imaginary plane 94 corresponds to an upper surface of the circuit board when the antenna 10 is mounted on the circuit board.

Referring to FIG. 3, when the antenna 10 is mounted on the circuit board, each of the first fixed portion 60, the second fixed portion 62 and the third fixed portion 64 is brought into direct contact with the circuit board. More specifically, when the antenna 10 is mounted on the circuit board, each of the first fixed portion 60, the second fixed portion 62 and the third fixed portion 64 is brought into direct contact with a corresponding one of the connecting pads. Each of the first fixed portion 60, the second fixed portion 62 and the third fixed portion 64 is fixed on the connecting pad corresponding thereto of the circuit board by soldering while the direct contact of each of the first fixed portion 60, the second fixed portion 62 and the third fixed portion 64 with the connecting pad corresponding thereto is maintained. This can prevent variation of attitude of the antenna 10 of the present embodiment upon mounting of the antenna 10 on the circuit board. Thus, the antenna 10 can have constant and stable characteristics upon mounting of the antenna 10 on the circuit board. Additionally, each of the first fixed portion 60, the second fixed portion 62 and the third fixed portion 64 is electrically connected with the ground plane via the connecting pad corresponding thereto.

Figure 5:
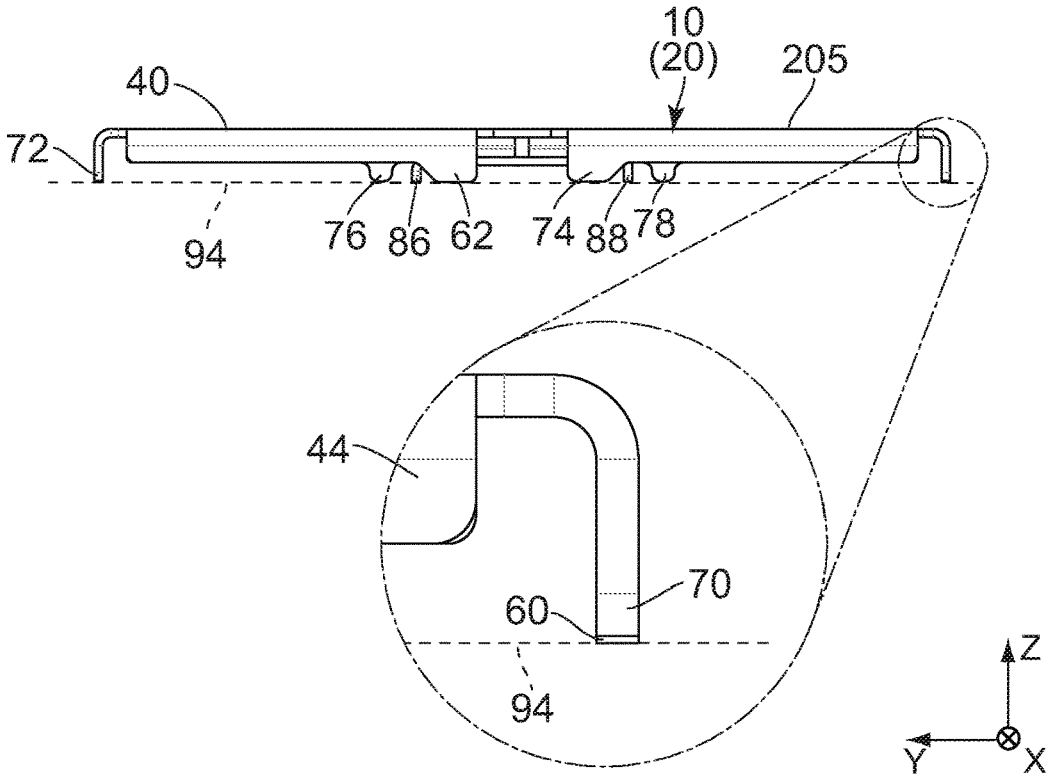
FIG. 5 is a rear view showing the antenna of FIG. 1. In the figure, a part of the antenna is illustrated enlarged.

Referring to FIG. 5, when the main portion 20 is deformed by applying external force to the main portion 20 under a state where the antenna 10 is mounted on the circuit board, the first reinforcing portion 70 of the present embodiment abuts against the circuit board to prevent the main portion 20 from being excessively deformed. A lower end of the first reinforcing portion 70 is positioned between the upper surface portion 40 and the imaginary plane 94 in the up-down direction. Specifically, under the state where the antenna 10 is mounted on the circuit board, the first reinforcing portion 70 is not fixed on the circuit board and is off the circuit board.

As shown in FIG. 2, the first reinforcing portion 70 extends from the upper surface portion 40. The first reinforcing portion 70 extends downward in the up-down direction from the upper surface portion 40. The first reinforcing portion 70 is provided on the second corner portion 32. The first reinforcing portion 70 is positioned below the second portion 203 in the up-down direction. The first reinforcing portion 70 is positioned between the first fixed portion 60 and the second fixed portion 62. Specifically, on the main portion 20, the first reinforcing portion 70 is positioned between the first fixed portion 60 and the second fixed portion 62. The first reinforcing portion 70 is positioned between the first fixed portion 60 and the first additional reinforcing portion 74. Specifically, on the main portion 20, the first reinforcing portion 70 is positioned between the first fixed portion 60 and the first additional reinforcing portion 74.

Figure 4:
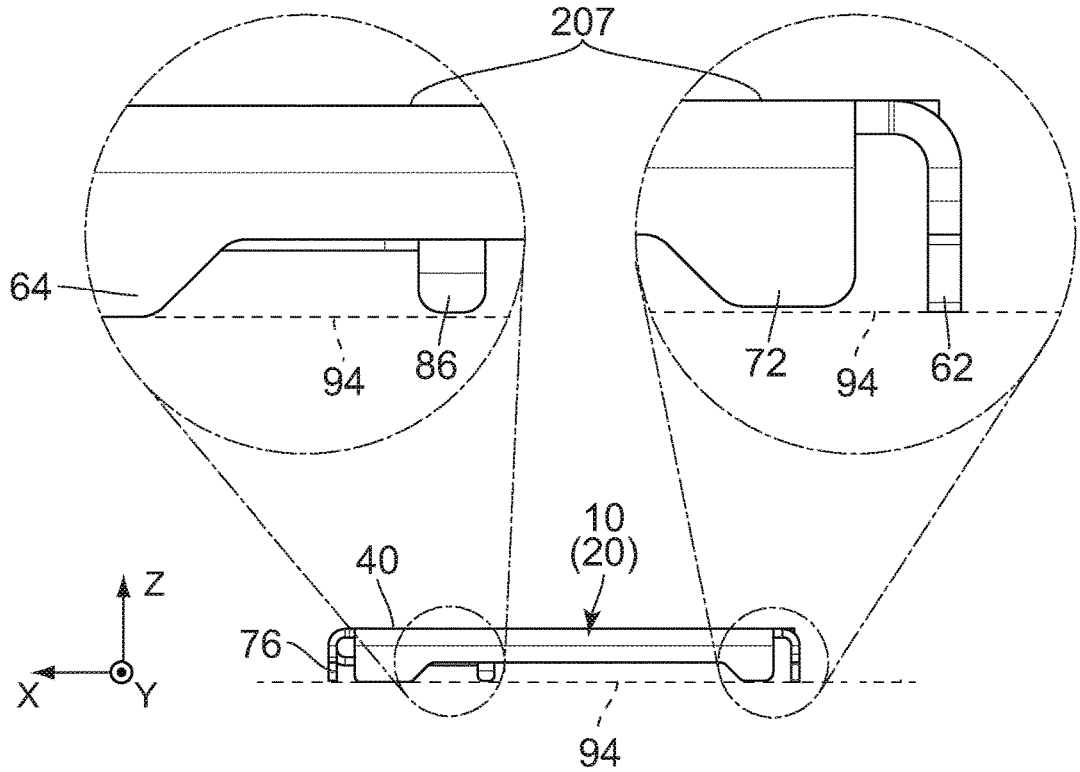
FIG. 4 is a right side view showing the antenna of FIG. 1. In the figure, a part of the antenna is illustrated enlarged.

Referring to FIG. 4, when the main portion 20 is deformed by applying external force to the main portion 20 under the state where the antenna 10 is mounted on the circuit board, the second reinforcing portion 72 of the present embodiment abuts against the circuit board to prevent the main portion 20 from being excessively deformed. A lower end of the second reinforcing portion 72 is positioned between the upper surface portion 40 and the imaginary plane 94 in the up-down direction. Specifically, under the state where the antenna 10 is mounted on the circuit board, the second reinforcing portion 72 is not fixed on the circuit board and is off the circuit board. As shown in FIG. 5, the arrangement of the first reinforcing portion 70 and the second reinforcing portion 72 is surface-symmetrical with respect to the reference plane. The first reinforcing portion 70 and the second reinforcing portion 72 are arranged mirror-symmetrically to each other across the third portion 205.

As shown in FIG. 2, the second reinforcing portion 72 extends from the upper surface portion 40. The second reinforcing portion 72 extends downward in the up-down direction from the upper surface portion 40. The second reinforcing portion 72 is provided on the third corner portion 34. The second reinforcing portion 72 is positioned below the fourth portion 207 in the up-down direction. The second reinforcing portion 72 is positioned between the second fixed portion 62 and the third fixed portion 64. Specifically, on the main portion 20, the second reinforcing portion 72 is positioned between the second fixed portion 62 and the third fixed portion 64.

As described above, each of the lower ends of the first reinforcing portion 70 and the second reinforcing portion 72 is positioned between the upper surface portion 40 of the main portion 20 and the imaginary plane 94 in the up-down direction. In other words, each of the lower ends of the first reinforcing portion 70 and the second reinforcing portion 72 is positioned above any of the lower ends of the first fixed portion 60, the second fixed portion 62 and the third fixed portion 64 in the up-down direction. Accordingly, none of the first reinforcing portion 70 and the second reinforcing portion 72 affects the attitude of the antenna 10 when the antenna 10 is mounted on the circuit board. In addition, if external force is applied to the main portion 20 under the state where the antenna 10 is mounted on the circuit board, the lower end of the first reinforcing portion 70 or the lower end of the second reinforcing portion 72 abuts against the circuit board to prevent the main portion 20 from being excessively deformed. Thus, the antenna 10 of the present embodiment is resistant to external force.

Referring to FIGS. 4 and 5, a distance from the first reinforcing portion 70 to the imaginary plane 94 in the up-down direction is defined so that the main portion 20 is not plastically deformed but is resiliently deformed. Similarly, a distance from the second reinforcing portion 72 to the imaginary plane 94 in the up-down direction is defined so that the main portion 20 is not plastically deformed but is resiliently deformed. More specifically, a distance between the imaginary plane 94 and the lower end of the first reinforcing portion 70 is defined so that, if external force is applied to the main portion 20 under the state where the antenna 10 is mounted on the circuit board, the distance allows resilient deformation of the main portion 20 while preventing plastic deformation of the main portion 20. Similarly, a distance between the imaginary plane 94 and the lower end of the second reinforcing portion 72 is defined so that, if external force is applied to the main portion 20 under the state where the antenna 10 is mounted on the circuit board, the distance allows resilient deformation of the main portion 20 while preventing plastic deformation of the main portion 20. Also, similarly, a distance between the imaginary plane 94 and the lower end of the feed portion 76 is defined so that, if external force is applied to the main portion 20 under the state where the antenna 10 is mounted on the circuit board, the distance allows resilient deformation of the main portion 20 while preventing plastic deformation of the main portion 20. The definitions of the distances enable that, when external force is applied to the main portion 20 under the state where the antenna 10 of the present embodiment is mounted on the circuit board, the lower end of the first reinforcing portion 70 or the lower end of the second reinforcing portion 72 abuts against the circuit board while the main portion 20 is deformed within its resilient deformation range. The definitions of the distances also enable that the main portion 20 restores its original shape when the external force applied to the main portion 20 is removed.

As shown in FIG. 2, the feed portion 76 of the present embodiment extends from the upper surface portion 40. More specifically, the feed portion 76 extends downward in the up-down direction from the upper surface portion 40. The feed portion 76 extends downward from the right portion 2014 of the first portion 201. As shown in FIG. 3, the lower end of the feed portion 76 is positioned between the upper surface portion 40 and the imaginary plane 94 in the up-down direction. The feed portion 76 is soldered on a corresponding one of the connecting pads when the antenna 10 is mounted on the circuit board. The feed portion 76 is not, however, brought into direct contact with the circuit board when the antenna 10 is mounted on the circuit board. Thus, the feed portion 76 does not affect the attitude of the antenna 100. The feed portion 76 is electrically connected with the feed line via the connecting pad corresponding thereto.

As shown in FIG. 2, the first additional reinforcing portion 74 of the present embodiment extends from the upper surface portion 40. The first additional reinforcing portion 74 extends downward in the up-down direction from the upper surface portion 40. The first additional reinforcing portion 74 extends downward in the up-down direction from the third portion 205. On the main portion 20, the first additional reinforcing portion 74 is positioned between the first fixed portion 60 and the second fixed portion 62. Referring to FIGS. 2 and 3, the arrangement of the first additional reinforcing portion 74 and second fixed portion 62 is surface-symmetrical with respect to the reference plane.

As shown in FIG. 3, a lower end of the first additional reinforcing portion 74 is positioned between the upper surface portion 40 and the imaginary plane 94 in the up-down direction. The first additional reinforcing portion 74 is fixed on the circuit board when the antenna 10 is mounted on the circuit board. More specifically, the first additional reinforcing portion 74 is soldered on a corresponding one of the connecting pads when the antenna 10 is mounted on the circuit board. The first additional reinforcing portion 74 is not, however, brought into direct contact with the circuit board when the antenna 10 is mounted on the circuit board. Thus, the first additional reinforcing portion 74 does not affect the attitude of the antenna 100. The first additional reinforcing portion 74 is electrically connected with the ground plane via the connecting pad corresponding thereto.

As shown in FIG. 2, the second additional reinforcing portion 78 extends from the upper surface portion 40. More specifically, the second additional reinforcing portion 78 extends downward in the up-down direction from the upper surface portion 40. The second additional reinforcing portion 78 extends downward from the left portion 2012 of the first portion 201. As shown in FIG. 3, a lower end of the second additional reinforcing portion 78 is positioned between the upper surface portion 40 and the imaginary plane 94 in the up-down direction. The second additional reinforcing portion 78 is soldered on a corresponding one of the connecting pads when the antenna 10 is mounted on the circuit board. The second additional reinforcing portion 78 of the present embodiment is not connected with any of the feed line and the ground plane.

Referring to FIG. 3, the arrangement of the second additional reinforcing portion 78 and the feed portion 76 is surface-symmetrical with respect to the reference plane. The second additional reinforcing portion 78 and the feed portion 76 are arranged mirror-symmetrically to each other across the facing portion 80. However, the present invention is not limited thereto. The arrangement of the second additional reinforcing portion 78 and the feed portion 76 may be asymmetrical.

As shown in FIG. 3, the second additional reinforcing portion 78 has a structure similar to that of the feed portion 76. However, the present invention is not limited thereto. Specifically, the second additional reinforcing portion 78 may have a shape and size different from the feed portion 76, or may have the same shape and size as the feed portion 76. However, it is easy to design the antenna 10 in a case where the feed portion 76 and the second additional reinforcing portion 78 have the same shape and size as each other and are arranged on symmetric positions when compared with other cases. Thus, it is preferable for the feed portion 76 and the second additional reinforcing portion 78 to have the same shape and size as each other.

Referring to FIG. 2, the portion 90 of the present embodiment is a cut-out portion which is formed by separating a blank (not shown) for the antenna 10 from a carrier (not shown) by cutting. Specifically, the antenna 10 of the present embodiment is manufactured as follows: a plurality of blanks, each of which is coupled with a carrier at one point, are punched out from a single metal plate to be obtained as one piece; each of the blanks coupled with the carrier is bent; and each of the bent blanks is separated from the carrier by cutting. However, the present invention is not limited thereto. The antenna 10 may be manufactured by separating the blanks from the carrier, followed by bending the separated blank.

As shown in FIG. 2, the main portion 20 of the present embodiment further has a first side portion 42, a second side portion 44, a third side portion 46, a fourth side portion 48, a fifth side portion 50 and a sixth side portion 52. Specifically, each of the first side portion 42, the second side portion 44, the third side portion 46, the fourth side portion 48, the fifth side portion 50 and the sixth side portion 52 extends downward from the upper surface portion 40.

As shown in FIG. 2, the first side portion 42 of the present embodiment is positioned between the first corner portion 30 and the second corner portion 32. The first side portion 42 is positioned between the first corner portion 30 and the second corner portion 32 in the front-rear direction. The first side portion 42 is positioned between the first fixed portion 60 and the first reinforcing portion 70 in the front-rear direction. The first side portion 42 extends downward from the second portion 203. Each of the first fixed portion 60 and the first reinforcing portion 70 is formed on the main portion 20 to neighbor on the first side portion 42. The first fixed portion 60 neighbors on a front side of the first side portion 42. The first reinforcing portion 70 neighbors on a rear side of the first side portion 42.

As shown in FIG. 2, the second side portion 44 of the present embodiment is positioned between the second corner portion 32 and the second fixed portion 62. The second side portion 44 is positioned between the second corner portion 32 and the second fixed portion 62 in the right-left direction. More specifically, the second side portion 44 is positioned between the second corner portion 32 and the first additional reinforcing portion 74 in the right-left direction. The second side portion 44 extends downward from the third portion 205. The first additional reinforcing portion 74 is formed on the main portion 20 to neighbor on a right side of the second side portion 44. At a left side of the second side portion 44, the main portion 20 is provided with no member equivalent to the first reinforcing portion 70. However, the present invention is not limited thereto. The main portion 20 may be provided with a member, which is equivalent to the first reinforcing portion 70, at the left side of the second side portion 44.

As shown in FIG. 2, the third side portion 46 of the present embodiment is positioned between the second fixed portion 62 and the third corner portion 34. The third side portion 46 is positioned between the second fixed portion 62 and the third corner portion 34 in the right-left direction. The third side portion 46 extends downward from the third portion 205. The second fixed portion 62 is formed on the main portion 20 to neighbor on a left side of the third side portion 46. At a right side of the third side portion 46, the main portion 20 is provided with no member equivalent to the second reinforcing portion 72. However, the present invention is not limited thereto. The main portion 20 may be provided with a member, which is equivalent to the second reinforcing portion 72, at the right side of the third side portion 46.

As shown in FIG. 2, the fourth side portion 48 of the present embodiment is positioned between the third corner portion 34 and the fourth corner portion 36. The fourth side portion 48 is positioned between the third corner portion 34 and the fourth corner portion 36 in the front-rear direction. The fourth side portion 48 is positioned between the third fixed portion 64 and the second reinforcing portion 72 in the front-rear direction. The fourth side portion 48 extends downward from the fourth portion 207. Each of the third fixed portion 64 and the second reinforcing portion 72 is formed on the main portion 20 to neighbor on the fourth side portion 48. The third fixed portion 64 neighbors on a front side of the fourth side portion 48. The second reinforcing portion 72 neighbors on a rear side of the fourth side portion 48.

As shown in FIG. 1, the fifth side portion 50 of the present embodiment is positioned between the fourth corner portion 36 and the facing portion 80. The fifth side portion 50 is positioned between the fourth corner portion 36 and the facing portion 80 in the right-left direction. The fifth side portion 50 is positioned between the fourth corner portion 36 and the second end portion 24 in the right-left direction. The fifth side portion 50 is positioned between the fourth corner portion 36 and the feed portion 76 in the right-left direction. The fifth side portion 50 extends downward from the right portion 2014 of the first portion 201. The feed portion 76 is formed on the main portion 20 to neighbor on a left side of the fifth side portion 50.

As shown in FIG. 1, the sixth side portion 52 of the present embodiment is positioned between the first corner portion 30 and the facing portion 80. The sixth side portion 52 is positioned between the first corner portion 30 and the facing portion 80 in the right-left direction. The sixth side portion 52 is positioned between the first corner portion 30 and the first end portion 22 in the right-left direction. The sixth side portion 52 is positioned between the first corner portion 30 and the second additional reinforcing portion 78 in the right-left direction. The sixth side portion 52 extends downward from the left portion 2012 of the first portion 201. The second additional reinforcing portion 78 is formed on the main portion 20 to neighbor on a right side of the sixth side portion 52.

As shown in FIG. 2, the lower end of each of the first reinforcing portion 70, the second reinforcing portion 72 and the feed portion 76 is positioned below any of lower ends of the first side portion 42, the second side portion 44, the third side portion 46 and the fourth side portion 48 in the up-down direction. More specifically, the lower end of each of the first reinforcing portion 70, the second reinforcing portion 72 and the feed portion 76 is positioned below any of lower ends of the first side portion 42, the second side portion 44, the third side portion 46, the fourth side portion 48, the fifth side portion 50 and the sixth side portion 52 in the up-down direction.

As shown in FIG. 1, the facing portion 80 of the present embodiment has a first facing portion 82, a second facing portion 84, a third additional reinforcing portion 86 and a fourth additional reinforcing portion 88. In other words, the antenna 10 comprises the first facing portion 82 and the second facing portion 84.

As shown in FIG. 1, the first facing portion 82 of the present embodiment extends from the first end portion 22. However, the present embodiment is not limited thereto. The first facing portion 82 may be modified, provided that the first facing portion 82 is provided on the first end portion 22 or extends from the first end portion 22.

As shown in FIG. 2, the second facing portion 84 of the present embodiment extends from the second end portion 24. However, the present embodiment is not limited thereto. The second facing portion 84 may be modified, provided that the second facing portion 84 is provided on the second end portion 24 or extends from the second end portion 24.

As understood from FIGS. 1 and 2, the first facing portion 82 and the second facing portion 84 are spaced away from each other and face each other. The first facing portion 82 and the second facing portion 84 form a capacitor. Since the main portion 20 forms the inductor as described above, the main portion 20 and the facing portion 80 form an LC resonator circuit.

Referring to FIG. 3, the third additional reinforcing portion 86 of the present embodiment is fixed on the circuit board when the antenna 10 is mounted on the circuit board.

A lower end of the third additional reinforcing portion 86 is positioned between the upper surface portion 40 and the imaginary plane 94 in the up-down direction. The third additional reinforcing portion 86 is soldered on a corresponding one of the connecting pads when the antenna 10 is mounted on the circuit board. The third additional reinforcing portion 86 of the present embodiment is not connected with any of the feed line and the ground plane.

As shown in FIG. 2, the third additional reinforcing portion 86 extends from the facing portion 80. More specifically, the third additional reinforcing portion 86 extends rightward from a right end of the first facing portion 82 and is then bent to extend downward.

Referring to FIG. 3, the fourth additional reinforcing portion 88 of the present embodiment is fixed on the circuit board when the antenna 10 is mounted on the circuit board. A lower end of the fourth additional reinforcing portion 88 is positioned between the upper surface portion 40 and the imaginary plane 94 in the up-down direction. The fourth additional reinforcing portion 88 is soldered on a corresponding one of the connecting pads when the antenna 10 is mounted on the circuit board. The fourth additional reinforcing portion 88 of the present embodiment is not connected with any of the feed line and the ground plane.

As shown in FIG. 2, the fourth additional reinforcing portion 88 extends from the facing portion 80. More specifically, the fourth additional reinforcing portion 88 extends leftward from a left end of the second facing portion 84 and is then bent to extend downward.

Where the present embodiment of the present invention is described above, the present embodiment may be modified as follows.

Figure 6:
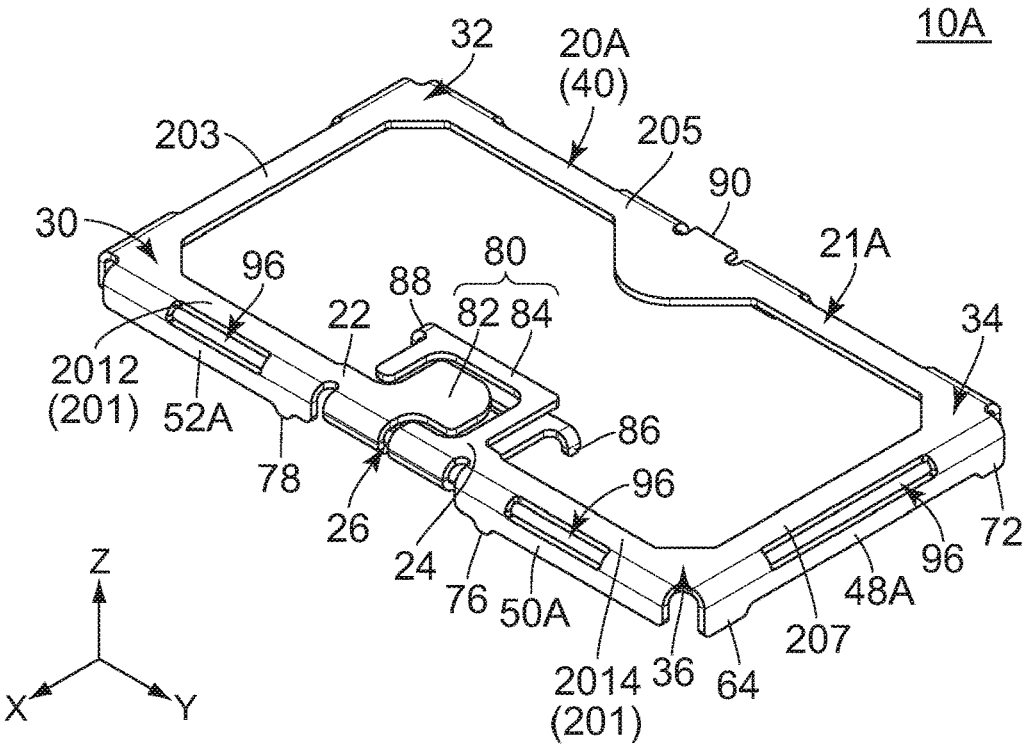
FIG. 6 is a top, perspective view showing a modification of the antenna of FIG. 1.

As shown in FIG. 6, an antenna 10A of a modification comprises a main portion 20A which forms a split ring 21A.

Figure 7:
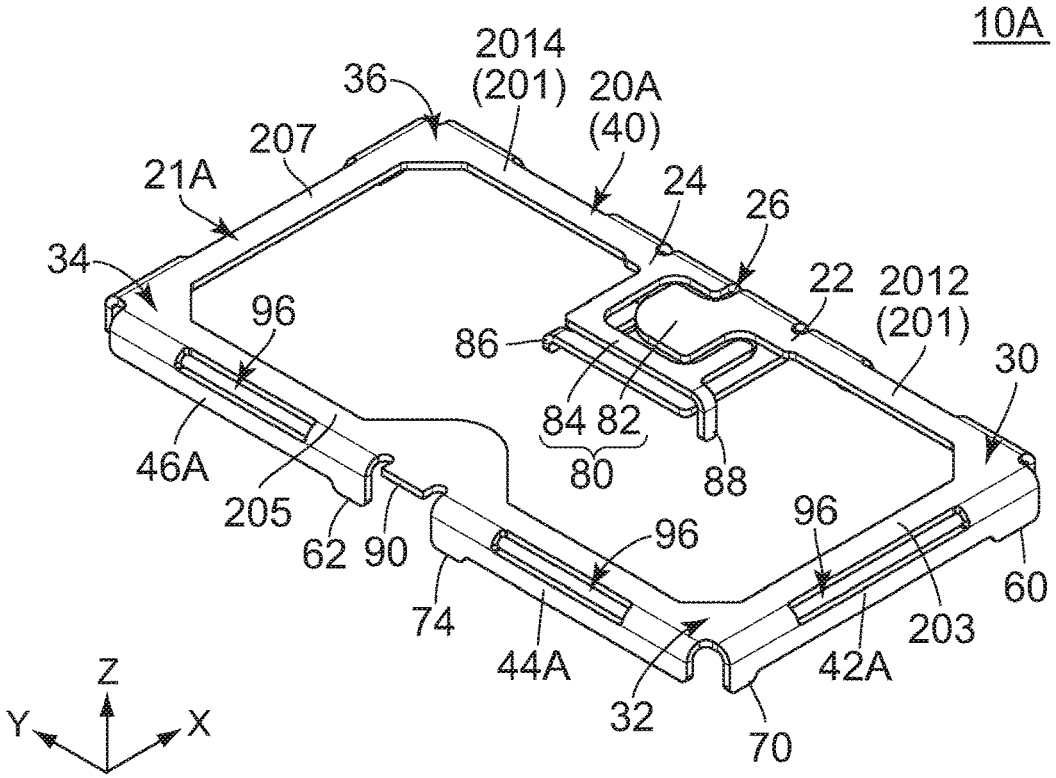
FIG. 7 is another top, perspective view showing the antenna of FIG. 6.
Figure 8:
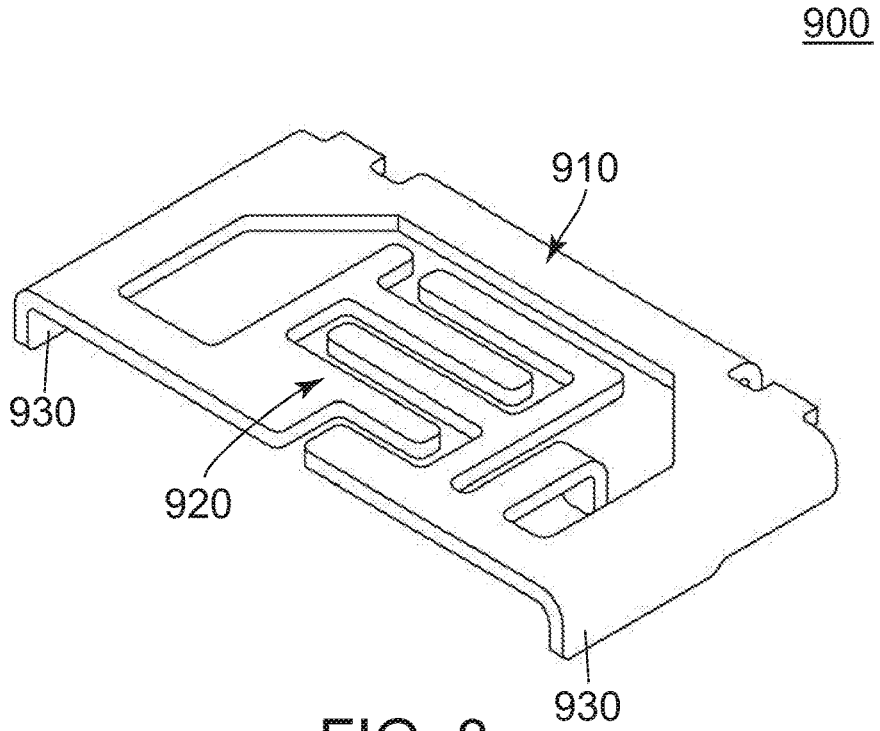
FIG. 8 PRIOR ART
FIG. 8 is a top, perspective view showing an antenna of JPS1633799.
Figure 9:
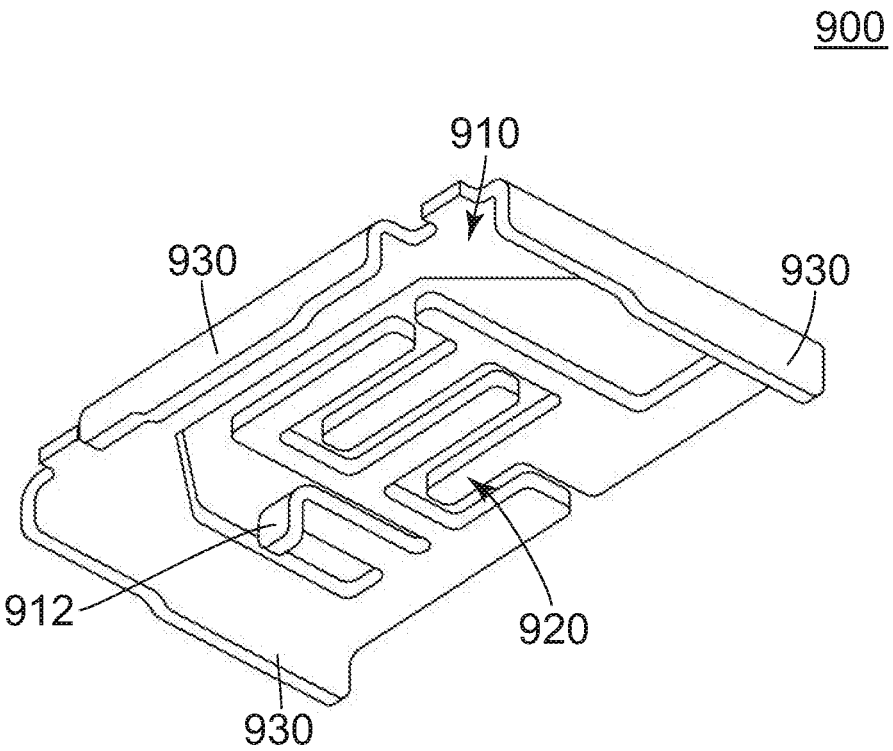
FIG. 9 PRIOR ART
FIG. 9 is a bottom, perspective view showing the antenna of FIG. 8.

As shown in FIGS. 6 and 7, the main portion 20A of the present modification has an upper surface portion 40, a first end portion 22, a second end portion 24, a first fixed portion 60, a second fixed portion 62, a third fixed portion 64, a first reinforcing portion 70, a second reinforcing portion 72, a first additional reinforcing portion 74, a feed portion 76, a second additional reinforcing portion 78, a portion 90, a first side portion 42A, a second side portion 44A, a third side portion 46A, a fourth side portion 48A, a fifth side portion 50A, a sixth side portion 52A and six slits 96. Components of the main portion 20A other than the first side portion 42A, the second side portion 44A, the third side portion 46A, the fourth side portion 48A, the fifth side portion 50A, the sixth side portion 52A and the slits 96 have structures same as the aforementioned embodiment. Accordingly, a detailed description thereabout is omitted.

As shown in FIGS. 6 and 7, the main portion 20A of the present modification is configured so that the first side portion 42A, the second side portion 44A, the third side portion 46A, the fourth side portion 48A, the fifth side portion 50A and the sixth side portion 52A correspond to the six slits 96, respectively.

As shown in FIG. 7, the first side portion 42A of the present modification is positioned between a first corner portion 30 and a second corner portion 32. The first side portion 42A is positioned between the first corner portion 30 and the second corner portion 32 in the front-rear direction. The first side portion 42A is positioned between the first fixed portion 60 and the first reinforcing portion 70 in the front-rear direction. The first side portion 42A extends downward from the upper surface portion 40. The first side portion 42A extends downward from a second portion 203. The first side portion 42A is positioned below the slit 96 corresponding thereto in the up-down direction. Each of the first fixed portion 60 and the first reinforcing portion 70 is formed on the main portion 20A to neighbor on the first side portion 42A. The first fixed portion 60 neighbors on a front side of the first side portion 42A. The first reinforcing portion 70 neighbors on a rear side of the first side portion 42A.

As shown in FIG. 7, the second side portion 44A of the present embodiment is positioned between the second corner portion 32 and the second fixed portion 62. The second side portion 44A is positioned between the second corner portion 32 and the second fixed portion 62 in the right-left direction. More specifically, the second side portion 44A is positioned between the second corner portion 32 and the first additional reinforcing portion 74 in the right-left direction. The second side portion 44A extends downward from the upper surface portion 40. The second side portion 44A extends downward from a third portion 205. The second side portion 44A is positioned below the slit 96 corresponding thereto in the up-down direction. The first additional reinforcing portion 74 is formed on the main portion 20A to neighbor on a right side of the second side portion 44A. At a left side of the second side portion 44A, the main portion 20A is provided with no member equivalent to the first reinforcing portion 70. However, the present invention is not limited thereto. The main portion 20A may be provided with a member equivalent to the first reinforcing portion 70 at the left side of the second side portion 44A.

As shown in FIG. 7, the third side portion 46A of the present modification is positioned between the second fixed portion 62 and a third corner portion 34. The third side portion 46A is positioned between the second fixed portion 62 and the third corner portion 34 in the right-left direction. The third side portion 46A extends downward from the upper surface portion 40. The third side portion 46A extends downward from the third portion 205. The third side portion 46A is positioned below the slit 96 corresponding thereto in the up-down direction. The second fixed portion 62 is formed on the main portion 20A to neighbor on a left side of the third side portion 46A. At a right side of the third side portion 46A, the main portion 20A is provided with no member equivalent to the second reinforcing portion 72 as shown in FIG. 6. However, the present invention is not limited thereto. The main portion 20A may be provided with a member equivalent to the second reinforcing portion 72 at the right side of the third side portion 46A.

As shown in FIG. 6, the fourth side portion 48A of the present modification is positioned between the third corner portion 34 and a fourth corner portion 36. The fourth side portion 48A is positioned between the third corner portion 34 and the fourth corner portion 36 in the front-rear direction. The fourth side portion 48A is positioned between the third fixed portion 64 and the second reinforcing portion 72 in the front-rear direction. The fourth side portion 48A extends downward from the upper surface portion 40. The fourth side portion 48A extends downward from a fourth portion 207. The fourth side portion 48A is positioned below the slit 96 corresponding thereto in the up-down direction. Each of the third fixed portion 64 and the second reinforcing portion 72 is formed on the main portion 20A to neighbor on the fourth side portion 48A. The third fixed portion 64 neighbors on a front side of the fourth side portion 48A. The second reinforcing portion 72 neighbors on a rear side of the fourth side portion 48A.

As shown in FIG. 6, the fifth side portion 50A of the present embodiment is positioned between the fourth corner portion 36 and a facing portion 80. The fifth side portion 50A is positioned between the fourth corner portion 36 and the facing portion 80 in the right-left direction. The fifth side portion 50A is positioned between the fourth corner portion 36 and the second end portion 24 in the right-left direction. The fifth side portion 50A is positioned between the fourth corner portion 36 and the feed portion 76 in the right-left direction. The fifth side portion 50A extends downward from the upper surface portion 40. The fifth side portion 50A extends downward from a right portion 2014 of a first portion 201. The fifth side portion 50A is positioned below the slit 96 corresponding thereto in the up-down direction. The feed portion 76 is formed on the main portion 20A to neighbor on a left side of the fifth side portion 50A.

As shown in FIG. 6, the sixth side portion 52A of the present modification is positioned between the first corner portion 30 and the facing portion 80. The sixth side portion 52A is positioned between the first corner portion 30 and the facing portion 80 in the right-left direction. The sixth side portion 52A is positioned between the first corner portion 30 and the first end portion 22 in the right-left direction. The sixth side portion 52A is positioned between the first corner portion 30 and the second additional reinforcing portion 78 in the right-left direction. The sixth side portion 52A extends downward from the upper surface portion 40. The sixth side portion 52A extends downward from a left portion 2012 of the first portion 201. The sixth side portion 52A is positioned below the slit 96 corresponding thereto in the up-down direction. The second additional reinforcing portion 78 is formed on the main portion 20A to neighbor on a right side of the sixth side portion 52A.

Referring to FIGS. 6 and 7, a lower end of each of the first reinforcing portion 70, the second reinforcing portion 72 and the feed portion 76 is positioned below any of lower ends of the first side portion 42A, the second side portion 44A, the third side portion 46A and the fourth side portion 48A in the up-down direction. More specifically, the lower end of each of the first reinforcing portion 70, the second reinforcing portion 72 and the feed portion 76 is positioned below any of lower ends of the first side portion 42A, the second side portion 44A, the third side portion 46A, the fourth side portion 48A, the fifth side portion 50A and the sixth side portion 52A in the up-down direction.

As shown in FIGS. 6 and 7, the main portion 20A has a first boundary, a second boundary, a third boundary, a fourth boundary, a fifth boundary and a sixth boundary. The first boundary is positioned between the first side portion 42A and the upper surface portion 40. The second boundary is positioned between the second side portion 44A and the upper surface portion 40. The third boundary is positioned between the third side portion 46A and the upper surface portion 40. The fourth boundary is positioned between the fourth side portion 48A and the upper surface portion 40. The fifth boundary is positioned between the fifth side portion 50A and the upper surface portion 40. The sixth boundary is positioned between the sixth side portion 52A and the upper surface portion 40. In the present embodiment, each of the first boundary, the second boundary, the third boundary, the fourth boundary, the fifth boundary and the sixth boundary is formed with the slit 96. However, the present invention is not limited thereto. The antenna 10A should be configured so that each of the first boundary, the second boundary, the third boundary and the fourth boundary is, at least in part, formed with the slit 96.

Since the antenna 10A of the present modification is configured so that the main portion 20A is provided with the slits 96 as described above, the main portion 20A has a lower spring constant as compares with an assumption where the main portion 20A be provided with no slit 96. Accordingly, when external force is applied to the main portion 20A under a state where the antenna 10 A of the present modification is mounted on a circuit board, the main portion 20A is more easily bent so that the first reinforcing portion 70 or the second reinforcing portion 72 abuts against the circuit board. This reduces load on fixed points between the circuit board and each of the first fixed portion 60 and the second fixed portion 62 and the third fixed portion 64.

Although the specific explanation about the present invention is made above referring to the embodiments, the present invention is not limited thereto and is susceptible to various modifications and alternative forms.

Although the first facing portion 82 and the second facing portion 84 of the present embodiment form the capacitor, the present invention is not limited thereto. The facing portion 80 may, for example, form an open stub or a short stub.

The antenna 10, 10A may further comprises a radiation element, which extends from the main portion 20, 20A, such as an inverted L-shape antenna.

Although the first reinforcing portion 70 of the present embodiment is formed on the main portion 20, 20A to neighbor on the first side portion 42, 42A, the present invention is not limited thereto. Specifically, the first reinforcing portion 70 may be formed on the main portion 20, 20A to neighbor on the second side portion 44, 44A.

Although the second reinforcing portion 72 of the present embodiment is formed on the main portion 20, 20A to neighbor on the fourth side portion 48, 48A, the present invention is not limited thereto. Specifically, the second reinforcing portion 72 may be formed on the main portion 20, 20A to neighbor on the third side portion 46, 46A.

Although the feed portion 76 of the present embodiment extends downward in the up-down direction from the upper surface portion 40, the present embodiment is not limited thereto. Specifically, the feed portion 76 may be modified, similar to the feed terminal 912 of the antenna 900 of Patent Document 1, so that the feed portion 76 extends rearward from the upper surface portion 40 and is then bent to extend downward.

Although the second additional reinforcing portion 78 of the present embodiment extends downward in the up-down direction from the upper surface portion 40, the present invention is not limited thereto. Specifically, the second additional reinforcing portion 78 may be modified so that the second additional reinforcing portion 78 extends rearward from the upper surface portion 40 and is then bent to extend downward.

Although the specific explanation about the present invention is made above referring to the embodiments, the present invention is not limited thereto and is susceptible to various modifications and alternative forms.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An antenna comprising a split ring resonator, wherein:

the antenna has a main portion which forms a split ring with a split portion;

the main portion has an upper surface portion, a first fixed portion, a second fixed portion, a third fixed portion, a first reinforcing portion, a second reinforcing portion, a feed portion, a first end portion and a second end portion;

each of the first fixed portion, the second fixed portion, the third fixed portion, the first reinforcing portion, the second reinforcing portion and the feed portion extends from the upper surface portion;

each of the first fixed portion, the second fixed portion and the third fixed portion is configured to be fixed on a circuit board when the antenna is mounted on the circuit board;

each of the first fixed portion, the second fixed portion and the third fixed portion has a lower end in an up-down direction;

the lower ends of the first fixed portion, the second fixed portion and the third fixed portion define an imaginary plane perpendicular to the up-down direction;

the first reinforcing portion and the second reinforcing portion are configured such that, when the main portion is deformed by applying external force to the main portion in a state in which the antenna is mounted on the circuit board, each of the first reinforcing portion and the second reinforcing portion abuts against the circuit board;

the first reinforcing portion is positioned between the first fixed portion and the second fixed portion;

the second reinforcing portion is positioned between the second fixed portion and the third fixed portion;

each of the first end portion and the second end portion is positioned between the first fixed portion and the third fixed portion;

the first end portion and the second end portion form the split portion of the split ring;

each of the first reinforcing portion, the second reinforcing portion and the feed portion has a lower end in the up-down direction;

each of the lower ends of the first reinforcing portion, the second reinforcing portion and the feed portion is positioned between the upper surface portion and the imaginary plane in the up-down direction; and the first reinforcing portion and the second reinforcing portion are configured such that, in the state in which the antenna is mounted on the circuit board, each of the first reinforcing portion and the second reinforcing portion is not fixed on the circuit board.

2. The antenna as recited in claim 1, wherein:

the antenna further comprises a first facing portion and a second facing portion;

the first facing portion is provided on the first end portion or extends from the first end portion;

the second facing portion is provided on the second end portion or extends from the second end portion; and the first facing portion and the second facing portion are spaced away from each other and face each other.

3. The antenna as recited in claim 2, wherein the first facing portion and the second facing portion form a capacitor.

4. The antenna as recited in claim 1, wherein the upper surface portion has a flat-plate shape.

5. The antenna as recited in claim 1, wherein each of the first reinforcing portion and the second reinforcing portion extends downward in the up-down direction from the upper surface portion.

6. The antenna as recited in claim 5, wherein the feed portion extends downward in the up-down direction from the upper surface portion.

7. The antenna as recited in claim 1, wherein:

the main portion has an angular C-shape;

the main portion has a first corner portion, a second corner portion, a third corner portion and a fourth corner portion;

the first fixed portion is provided on the first corner portion;

the second fixed portion is positioned between the second corner portion and the third corner portion;

the third fixed portion is provided on the fourth corner portion;

each of the first end portion and the second end portion is positioned between the first corner portion and the fourth corner portion;

the first reinforcing portion is provided on the second corner portion; and the second reinforcing portion is provided on the third corner portion.

8. The antenna as recited in claim 7, wherein:

the main portion further has a first side portion, a second side portion, a third side portion and a fourth side portion;

each of the first side portion, the second side portion, the third side portion and the fourth side portion extends downward in the up-down direction from the upper surface portion;

the first side portion is positioned between the first corner portion and the second corner portion;

the second side portion is positioned between the second corner portion and the second fixed portion;

the third side portion is positioned between the second fixed portion and the third corner portion;

the fourth side portion is positioned between the third corner portion and the fourth corner portion;

each of the first side portion, the second side portion, the third side portion and the fourth side portion has a lower end in the up-down direction; and each of the lower ends of the first reinforcing portion, the second reinforcing portion and the feed portion is positioned below any of the lower ends of the first side portion, the second side portion, the third side portion and the fourth side portion in the up-down direction.

9. The antenna as recited in claim 8, wherein:

the main portion has a first boundary, a second boundary, a third boundary and a fourth boundary;

the first boundary is positioned between the first side portion and the upper surface portion;

the second boundary is positioned between the second side portion and the upper surface portion;

the third boundary is positioned between the third side portion and the upper surface portion;

the fourth boundary is positioned between the fourth side portion and the upper surface portion; and each of the first boundary, the second boundary, the third boundary and the fourth boundary is, at least in part, formed with a slit.

10. The antenna as recited in claim 1, wherein:

a distance from the first reinforcing portion to the imaginary plane in the up-down direction is defined so that the main portion is not plastically deformed but is resiliently deformed; and a distance from the second reinforcing portion to the imaginary plane in the up-down direction is defined so that the main portion is not plastically deformed but is resiliently deformed.

* * * * *